US006715857B2

(12) United States Patent
Coffey et al.

(10) Patent No.: US 6,715,857 B2
(45) Date of Patent: Apr. 6, 2004

(54) PRINTHEAD CARRIER HOUSING AND FLEXIBLE PRINTED CIRCUIT ATTACHED TO SAME

(75) Inventors: Johnnie A. Coffey, Winchester, KY (US); Brian Dale Cook, Nicholasville, KY (US); Steven Andrew Rice, Shelbyville, KY (US)

(73) Assignee: Lexmark International, Inc., Lexington, KY (US)

( * ) Notice: Subject to any disclaimer, the term of this patent is extended or adjusted under 35 U.S.C. 154(b) by 43 days.

(21) Appl. No.: 10/235,515

(22) Filed: Sep. 5, 2002

(65) Prior Publication Data

US 2004/0046836 A1 Mar. 11, 2004

(51) Int. Cl.[7] ..... B41J 23/00; B41J 2/14
(52) U.S. Cl. ..... 347/37; 347/49
(58) Field of Search ..... 347/47, 50, 66, 347/86, 87, 91, 104, 108, 37, 49; 400/11, 357

(56) References Cited

U.S. PATENT DOCUMENTS

| | | | | |
|---|---|---|---|---|
| 4,755,836 A | | 7/1988 | Ta et al. | 347/49 |
| 5,539,436 A | | 7/1996 | Wilson et al. | 347/37 |
| 5,684,518 A | | 11/1997 | Nobel et al. | 347/50 |
| 6,003,974 A | | 12/1999 | Wilson et al. | 347/50 |
| 6,007,184 A | | 12/1999 | Terasawa et al. | 347/50 |
| 6,137,508 A | | 10/2000 | Gaarder | 347/50 |
| 6,280,017 B1 | | 8/2001 | Miyauchi | 347/49 |
| 6,609,792 B2 | * | 8/2003 | Kaga et al. | 347/104 |

* cited by examiner

*Primary Examiner*—Hai Pham
(74) *Attorney, Agent, or Firm*—Taylor & Aust, P.C.

(57) ABSTRACT

A carrier assembly includes a carrier housing defined in part by a wall having an interior surface, an exterior surface and a distal end. A slot extends between the interior surface of the wall and the exterior surface of the wall, the slot being spaced apart from the distal end. At least one first projecting member is positioned adjacent the slot. A circuit card is mounted to the exterior surface of the wall. A printhead cable in the form of a flexible printed circuit is provided having a first end portion and a second end portion. The first end portion is secured to the circuit card. The flexible printed circuit is laced through the slot, the flexible printed circuit including at least one hole to correspondingly receive the at least one first projecting member. The second end portion passes over a portion of the interior surface and around the distal end of the wall. An attachment mechanism secures the second end portion to the exterior surface of the wall.

34 Claims, 4 Drawing Sheets

PRINTHEAD CARRIER HOUSING AND FLEXIBLE PRINTED CIRCUIT ATTACHED TO SAME

BACKGROUND OF THE INVENTION

1. Field of the Invention

The present invention relates to an imaging device, and, more particularly, to a printhead carrier and flexible printed circuit attached to the same.

2. Description of the Related Art

A typical imaging device, such as an ink jet printer, forms an image on a print medium by depositing an imaging substance, such as ink, on a surface of the print medium. In an ink jet printer, for example, a reciprocating printhead carrier carries one or more printhead cartridges that form an image on a print medium by selectively ejecting ink from a plurality of ink jetting nozzles of the printhead(s) to form a pattern of ink dots on the print medium. Associated with each of the ink jetting nozzles is an electrical actuator, such as a heater element or a piezoelectric element, which when energized ejects the ink from the respective jetting nozzle.

In order to provide electrical energy to the electrical actuators, a printhead cable is attached to the carrier that leads from a carrier circuit card to the contacts of the printhead cartridge. Traditionally, the printhead cable, in the form of a flexible printed circuit, includes mounting holes for receiving mounting posts located on sides of the carrier, wherein this arrangement holds the printhead cable in horizontal tension, with the printhead cable being restrained by two clamps, one cable at each end of the printhead cable. Further, such as arrangement of the printhead cable adds to the horizontal width of the carrier.

What is needed in the art is an improved printhead cable mounting arrangement.

SUMMARY OF THE INVENTION

The present invention provides an improved mounting arrangement for mounting a printhead cable to a carrier housing.

In one form thereof, the present invention relates to a carrier assembly including a carrier housing defined in part by a wall having an interior surface, an exterior surface and a distal end. A slot extends between the interior surface of the wall and the exterior surface of the wall, the slot being spaced apart from the distal end. At least one first projecting member is positioned adjacent the slot. A circuit card is mounted to the exterior surface of the wall. A printhead cable in the form of a flexible printed circuit is provided having a first end portion and a second end portion. The first end portion is secured to the circuit card. The flexible printed circuit is laced through the slot. The flexible printed circuit includes at least one hole to correspondingly receive the at least one first projecting member. The second end portion passes over a portion of the interior surface and around the distal end of the wall. An attachment mechanism secures the second end portion to the exterior surface of the wall.

In another form thereof, the invention relates to an imaging device. The imaging device includes a housing defined in part by a wall having an interior surface, an exterior surface and a distal end. A slot extends between the interior surface of the wall and the exterior surface of the wall. The slot is spaced apart from the distal end. A first plurality of projecting members are positioned adjacent to the slot, and a second plurality of projecting members extends from the exterior surface of the wall. A circuit card is mounted to the exterior surface of the wall. A flexible printed circuit has a first end portion and a second end portion, the first end portion being secured to the circuit card. The flexible printed circuit includes a first plurality of holes to correspondingly receive the first plurality of projecting members and includes a second plurality of holes to correspondingly receive the second plurality of projecting members. The flexible printed circuit is laced through the slot, the second end portion passing over a portion of the interior surface and around the distal end of the wall.

One advantage of the present invention is that the horizontal extent of the carrier assembly can be reduced.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
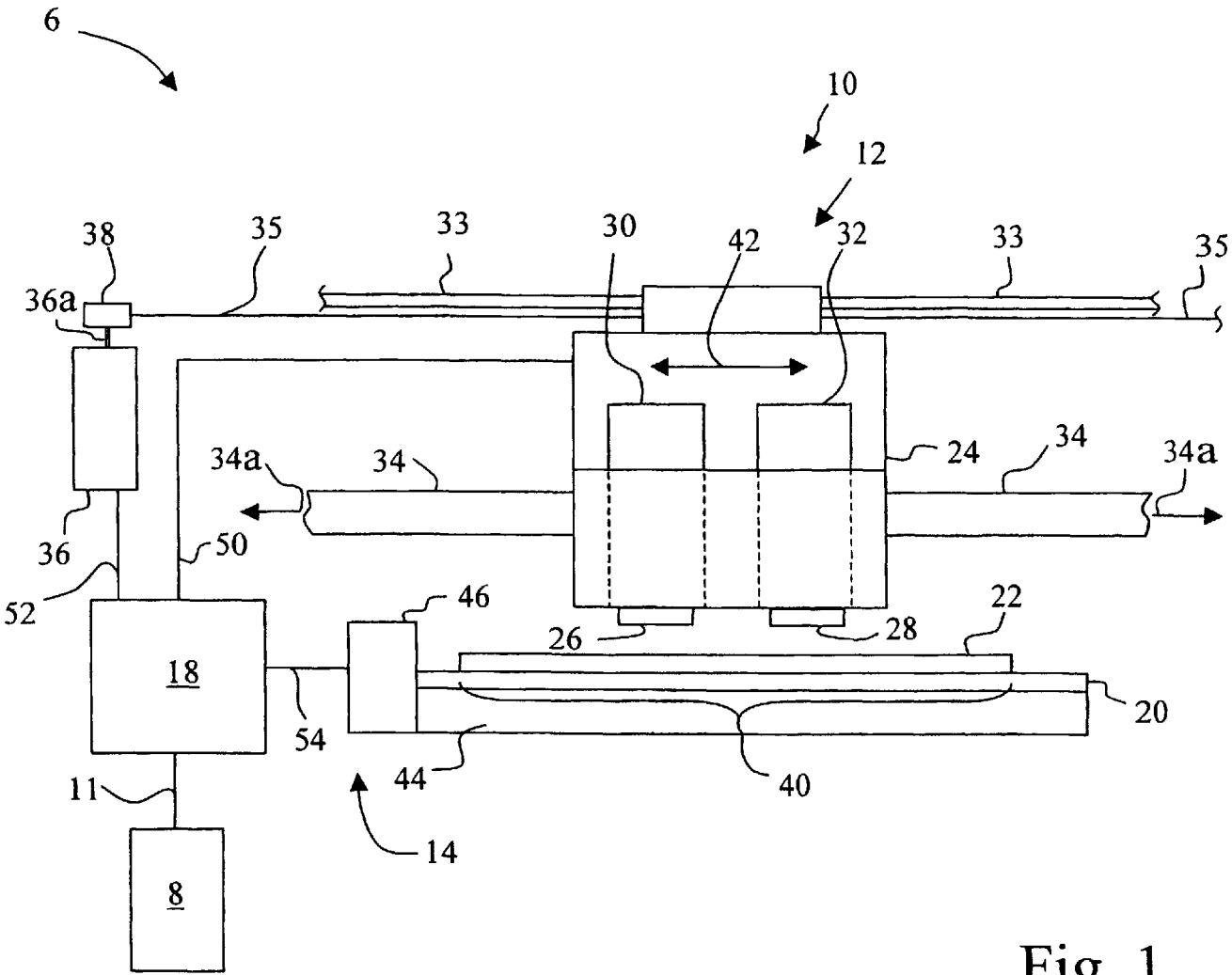
FIG. 1 is a diagrammatic representation of an imaging system embodying the present invention.

Referring now to the drawings and particularly to FIG. 1, there is shown an imaging system 6 embodying the present invention. Imaging system 6 includes a computer 8 and an imaging device in the form of an ink jet printer 10. Computer 8 is communicatively coupled to ink jet printer 10 via a communications link 11. Communications link 11 may be, for example, a direct electrical or optical connection, or a network connection.

Computer 8 is typical of that known in the art, and includes a display, an input device, e.g., a keyboard, a processor, and associated memory. Resident in the memory of computer 8 is printer driver software. The printer driver software places print data and print commands in a format that can be recognized by ink jet printer 10.

Ink jet printer 10 includes a printhead carrier system 12, a feed roller unit 14, a controller 18 and a mid-frame 20. Also shown is a sheet of print media 22.

Printhead carrier system 12 includes a carrier assembly 24 for carrying a monochrome, e.g., black, printhead 26 and a color printhead 28. A monochrome ink reservoir 30 is provided in fluid communication with monochrome printhead 26, and a color ink reservoir 32 is provided in fluid communication with color printhead 28. Monochrome printhead 26 and monochrome ink reservoir 30 may form an integral monochrome printhead cartridge 26, 30. Color printhead 28 and color ink reservoir 32 may form an integral color printhead cartridge 28, 32. Printhead carrier system 12 and printheads 26, 28 may be configured for unidirectional printing or bi-directional printing.

Carrier assembly 24 is guided by a guide rail 33 and a guide rod 34. An axis 34*a* of guide rod 34 defines a bi-directional scanning path for carrier assembly 24, and thus, for convenience the bi-directional scanning path will be referred to as bi-directional scanning path 34*a*. Carrier assembly 24 is connected to a carrier transport belt 35 that is driven by a carrier motor 36 via a pulley 38 to transport carrier assembly 24 in a reciprocating manner along guide rail 33 and guide rod 34. Carrier motor 36 can be, for example, a direct current (DC) motor or a stepper motor. Carrier motor 36 has a rotating carrier motor shaft 36*a* that is attached to pulley 38.

The reciprocation of carrier assembly 24 transports ink jet printheads 26, 28 across a sheet of print media 22, such as paper, supported by mid-frame 20 along bi-directional scanning path 34*a* to define a print zone 40 of printer 10. This reciprocation occurs in a main scan direction 42 that is parallel with bi-directional scanning path 34*a,* and is also commonly referred to as the horizontal direction.

Feed roller unit 14 includes an index roller 44 and corresponding index pinch rollers (not shown). Index roller 44 is driven by a drive unit 46. The index pinch rollers apply a biasing force to hold the sheet of print media 22 in contact with respective driven index roller 44. Drive unit 46 includes a drive source, such as a stepper motor, and an associated drive mechanism, such as a gear train or belt/pulley arrangement.

Controller 18 is electrically connected to printheads 26 and 28 via a printhead interface cable 50. Controller 18 is electrically connected to carrier motor 36 via interface cable 52. Controller 18 is electrically connected to drive unit 46 via interface cable 54. Controller 18 includes a microprocessor having an associated random access memory (RAM) and read only memory (ROM). Controller 18 executes program instructions to effect the printing of an image on the sheet of print media 22, such as coated paper, plain paper, photo paper and transparency.

During normal printing, computer 8 supplies to ink jet printer 10 a data packet for a swath of print data. A swath is an area of print coverage along bi-directional scanning path a having a height of the printhead. Each data packet includes a print header that identifies the swath to be printed. Controller 18 of ink jet printer 10 receives the data packet and extracts therefrom the print header, print commands and print data. Controller 18 then controls index roller 44 via drive unit 46 to incrementally advance print medium sheet 22, toward and into a print zone 40 across mid-frame 20. At each increment of advancement of print medium sheet 22, controller 18 controls the ink ejections of printheads 26 and/or 28, and controls the reciprocation of carrier assembly 24 via carrier motor 36.

Figure 2:
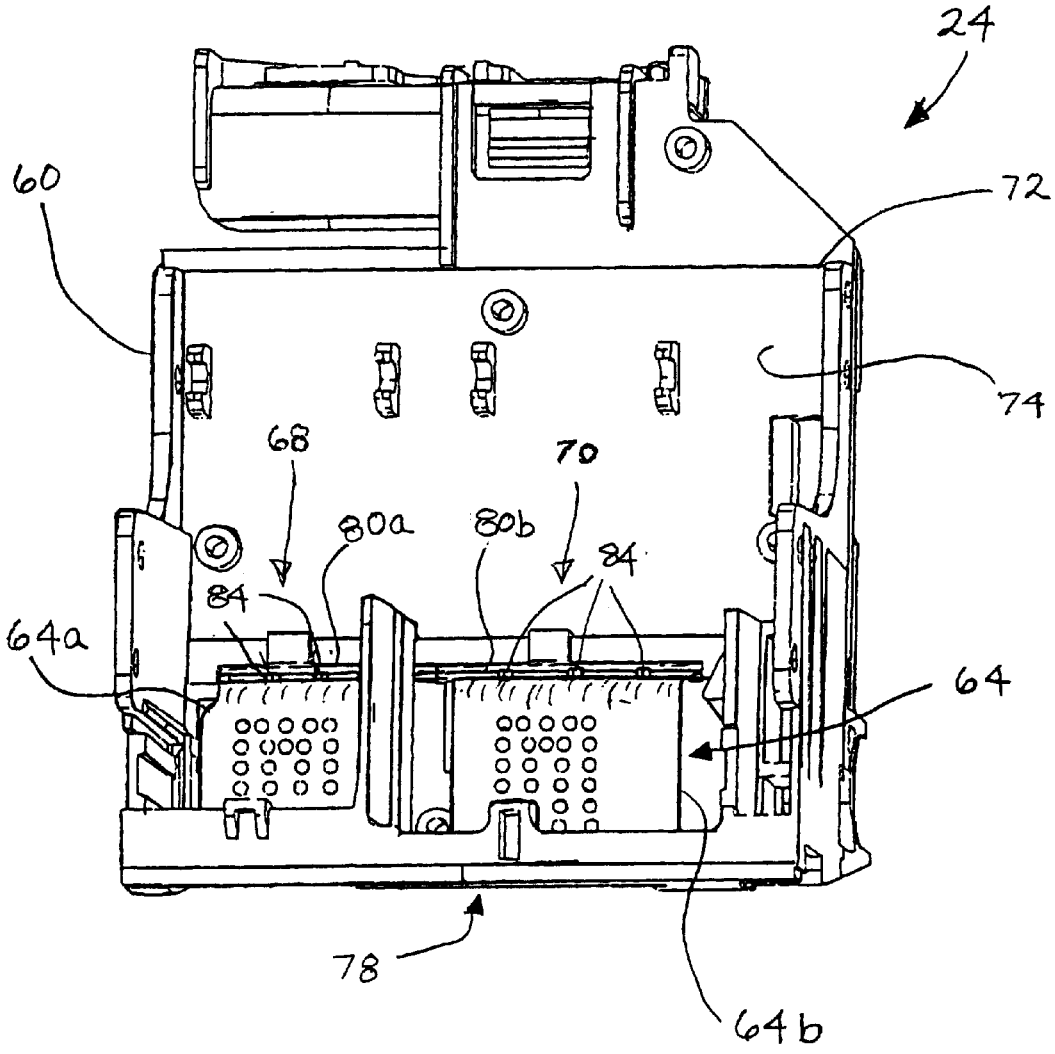
FIG. 2 is a perspective front view of a carrier housing of the carrier assembly of FIG. 1.
Figure 3:
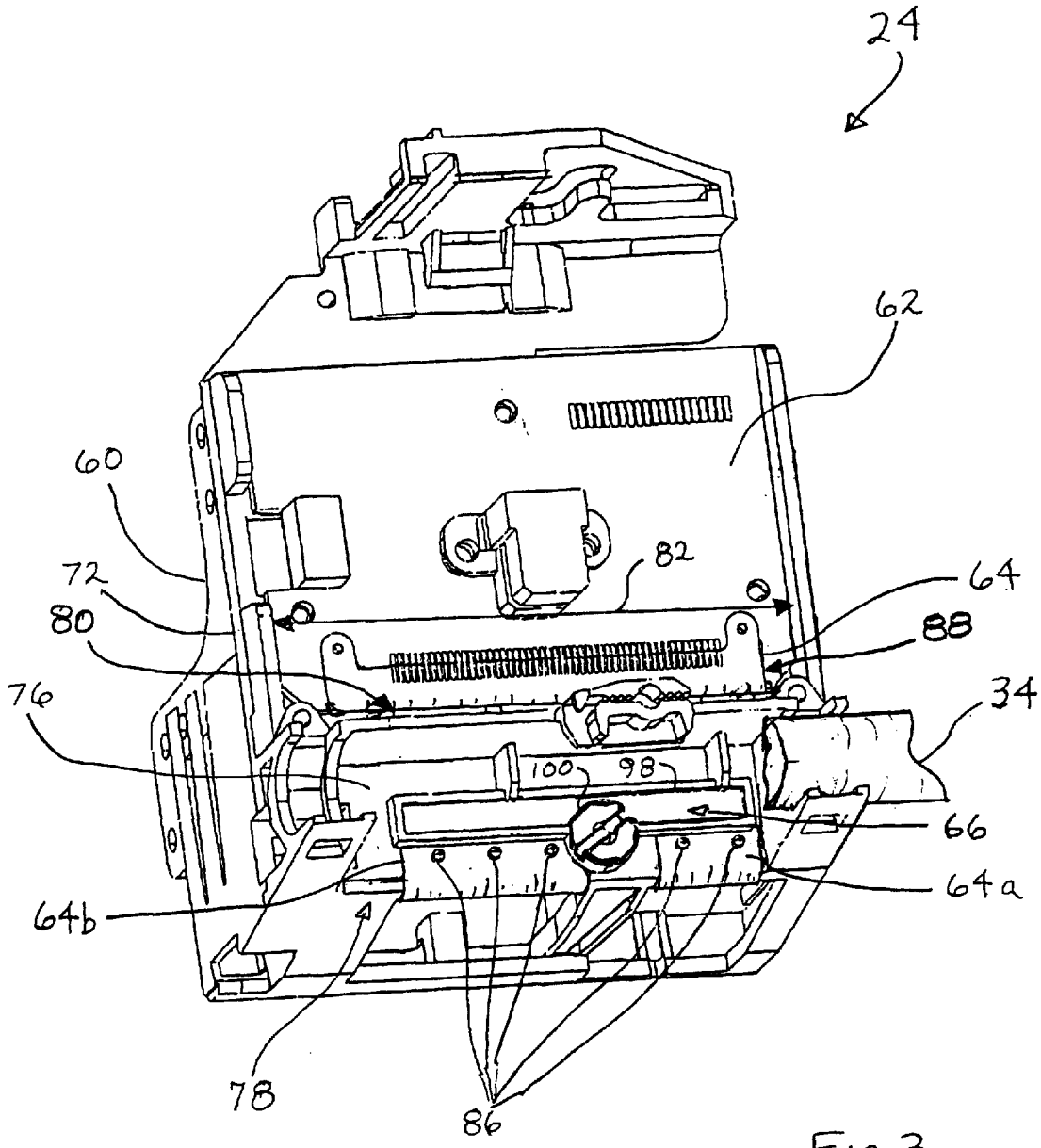
FIG. 3 is a perspective rear view of a carrier housing of the carrier assembly of FIG. 1.
Figure 4:
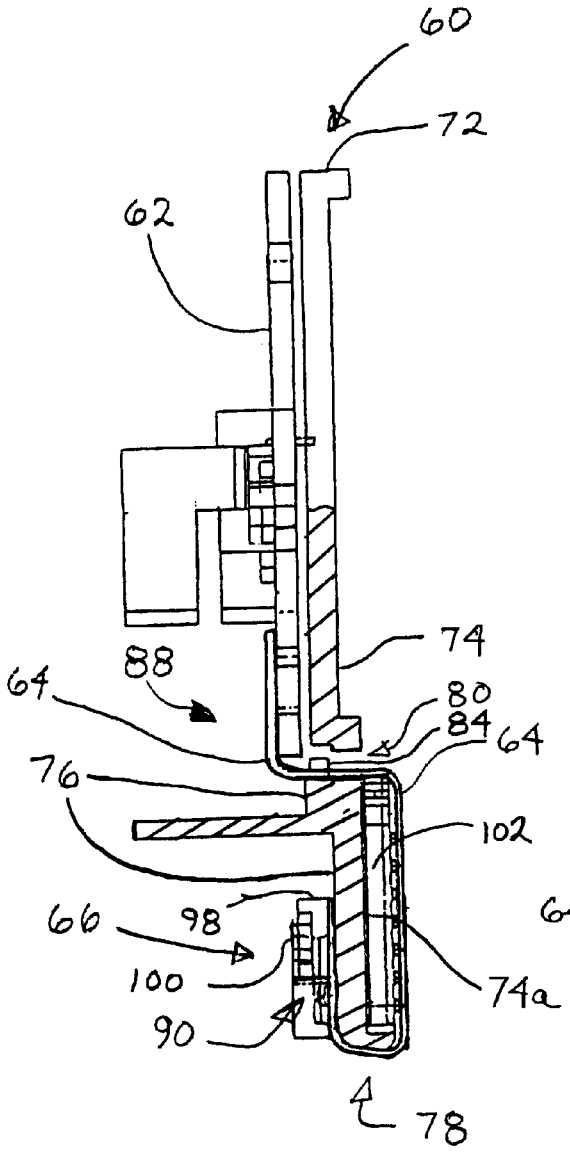
FIG. 4 is a partially sectioned side view of a wall of the carrier housing of the carrier assembly of FIG. 1.

Referring now to FIGS. 2–4, a portion of carrier assembly 24 is shown in more detail. Carrier assembly 24 includes a carrier housing 60, a carrier circuit card 62, a flexible printed circuit 64 and an attachment mechanism 66.

Carrier housing 60 defines a monochrome cartridge bay 68 and a color cartridge bay 70 for mounting, respectively, a monochrome printhead cartridge 26, 30 and a color printhead cartridge 28, 32. Each of bays 68, 70 is defined in part by a wall 72 of carrier housing 60 having an interior surface 74, an exterior surface 76 and a distal end 78. A slot 80, including slot portions 80*a* and 80*b,* extends through wall 72 between interior surface and exterior surface of wall 72. Slot portions 80*a,* 80*b* may define a single slot, or alternatively, define separate slots. In any event, slot portions 80*a,* 80*b* will be collectively referred to as slot 80. As shown, slot 80 is spaced apart from distal end 78. Slot 80 extends substantially across an entire width 82 of wall 72. As can be best seen in FIGS. 2 and 4, a plurality of projecting members 84, such as posts, of wall 72 are positioned adjacent slot 80 and extend along the plane of wall 72 vertically into slot 80 so as to form a set of anchor points for flexible printed circuit 64. As can be best seen in FIG. 3, another plurality of projecting members 86, such as posts, perpendicularly extend from exterior surface 76 of wall 72. The plurality of projecting members 84 and the plurality of projecting members 86 may be molded integral with carrier housing 60.

Carrier circuit card 62 is mounted to exterior surface 76 of wall 72. Carrier circuit card 62 includes electrical and electronic components for conditioning signals, including forwarding command and/or ink ejection firing signals to one or both of printheads 26, 28.

Figure 5:
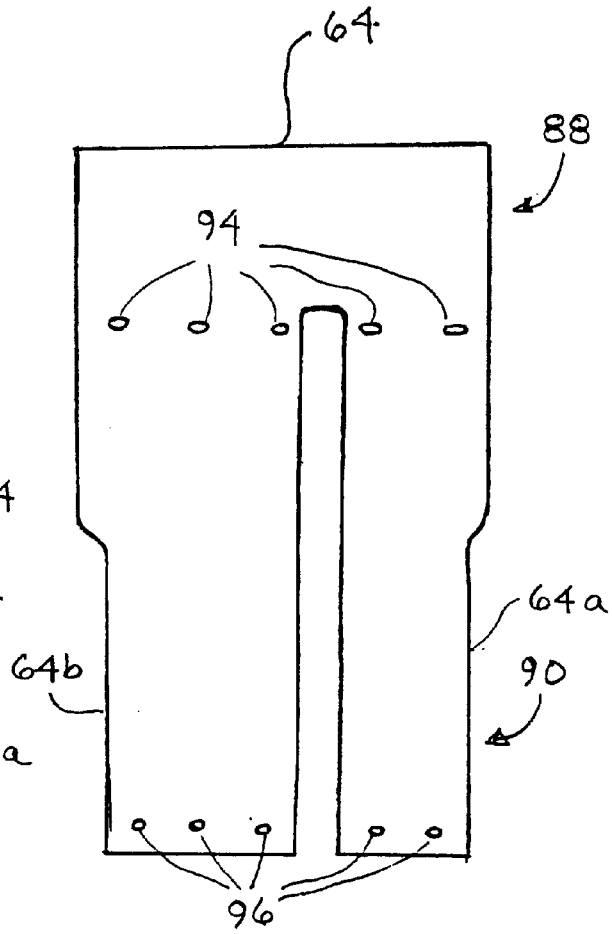
FIG. 5 shows a flexible printed circuit.

Referring to FIG. 5, flexible printed circuit 64 has a first leg 64*a,* a second leg 64*b,* a first end portion 88 and a second end portion 90. Flexible printed circuit 64 may be, for example, made from a pliable plastic substrate having disposed thereon a plurality of printed circuit traces. Referring again to FIG. 3, first end portion 88 is secured to carrier circuit card 62, such as for example, by solder using a hot bar solder joint technique.

As can be best seen in FIG. 4, to mount flexible printed circuit 64 to carrier housing 60, flexible printed circuit 64 is laced through slot 80 from exterior surface 76 of wall 72 to interior surface 74 of wall 72. Second end portion 90 passes over a portion 74*a* of interior surface 74, passes around distal end 78 of wall 72 and returns to exterior surface 76.

Referring to FIG. 5, flexible printed circuit 64 includes a plurality of holes 94 near first end portion 88 to correspondingly receive the plurality of projecting members 84. Also, flexible printed circuit 64 includes a plurality of holes 96 located near second end portion 90 to correspondingly receive the plurality of projecting members 86.

Attachment mechanism 66 secures second end portion 90 to exterior surface 76 of wall 72. Attachment mechanism 66 can be considered to include the plurality of projecting members 86 extending from exterior surface 76 of wall 72 of carrier housing 60. Attachment mechanism 66 also includes a clamp 98. Clamp 98 secures second end portion 90 of flexible printed circuit 64 to exterior surface 76 of wall 72 of carrier housing 60. Clamp 98 is held firmly in place by a fastener, such as a bolt or screw, 100.

In the orientation as shown, flexible printed circuit 64 is held in a state of vertical tension between the plurality of projecting members 84 and the plurality of projecting members 86. In other words, the plurality of projecting members 84 serve as an upper restraint for the flexible printed circuit 64, and the plurality of projecting members 86 serve as a lower restraint for the flexible printed circuit 64. Referring to FIG. 4, in order to effect the vertical tension, a resilient member, such as a rubber backer, 102 is placed behind the flexible printed circuit 64, i.e., between portion 74*a* of interior surface 74 of wall 72 and flexible printed circuit 64. This tension holds the first end portion 88 of flexible printed circuit 64 in place on the upper set of posts, i.e., the plurality of projecting members 84, without a clamp.

Thus, the present invention provides attachment of flexible printed circuit 64 to carrier housing 60 with minimal carrier width and a simplified clamping scheme. No extra space is required on the sides of flexible printed circuit 64 to accommodate clamps. Rather, the invention allows both legs 64*a,* 64*b* of flexible printed circuit 64 to be restrained by a common clamp 98.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A carrier assembly, comprising:

a carrier housing defined in part by a wall having an interior surface, an exterior surface and a distal end, and having a slot extending between said interior surface of said wall and said exterior surface of said wall, said slot being spaced apart from said distal end, and having at least one first projecting member positioned adjacent to said slot;

a circuit card mounted to said exterior surface of said wall;

a flexible printed circuit having a first end portion and a second end portion, said first end portion being secured to said circuit card, said flexible printed circuit being laced through said slot, said flexible printed circuit including at least one hole to correspondingly receive said at least one first projecting member, said second end portion passing over a portion of said interior surface and around said distal end of said wall; and an attachment mechanism for securing said second end portion to said exterior surface of said wall.

2. The carrier assembly of claim 1, said at least one first projecting member including a first plurality of projecting members, and said at least one hole including a corresponding first plurality of holes to receive said first plurality of projecting members.

3. The carrier assembly of claim 1, wherein said at least one projecting member includes at least one post that extends into said slot.

4. The carrier assembly of claim 1, said attachment mechanism including at least one second projecting member extending from said exterior surface of said wall of said carrier housing, and said flexible printed circuit including at least one opening located near said second end portion to correspondingly receive said at least one second projecting member, said flexible printed circuit being held in a state of tension between said at least one first projecting member and said at least one second projecting member.

5. The carrier assembly of claim 4, wherein said state of tension is effected by inserting a resilient member between said portion of said interior surface of said wall and said flexible printed circuit.

6. The carrier assembly of claim 4, wherein:

said at least one first projecting member includes a first plurality of projecting members extending into said slot and wherein said at least one hole includes a corresponding first plurality of holes to receive said first plurality of projecting members; and said at least one second projecting member includes a second plurality of projecting members extending from said wall of said carrier housing and said at least one opening includes a corresponding second plurality of holes to receive said second plurality of projecting members, and wherein when said flexible printed circuit is mounted to said carrier housing, said flexible printed circuit is held in a state of tension between said first plurality of projecting members and said second plurality of projecting members.

7. The carrier assembly of claim 6, wherein said state of tension is effected by inserting a resilient member between said portion of said interior surface of said wall and said flexible printed circuit.

8. The carrier assembly of claim 6, wherein each of said first plurality of projecting members includes a first plurality of posts and wherein each of said plurality of second projecting members comprises a second plurality of posts.

9. The carrier assembly of claim 1, said attachment mechanism including a clamp.

10. The carrier assembly of claim 1, said attachment mechanism including:

a plurality of projecting members extending from said exterior surface of said wall of said carrier housing to receive a corresponding plurality of holes located near said second end portion of said flexible printed circuit; and a clamp to secure said second end portion of said flexible printed circuit to said exterior surface of said wall of said carrier housing.

11. The carrier assembly of claim 1, wherein said first end portion of said flexible printed circuit is secured to said circuit card by solder.

12. The carrier assembly of claim 1, wherein said slot extends substantially across an entire width of said wall.

13. The carrier assembly of claim 1, wherein said slot comprises a plurality of slots.

14. An imaging device, comprising:

a mid-frame for supporting a sheet of print media;

a carrier housing for carrying at least one printhead over said mid-frame, said carrier housing defined in part by a wall having an interior surface, an exterior surface and a distal end, and having a slot extending between said interior surface of said wall and said exterior surface of said wall, said slot being spaced apart from said distal end, and having at least one first projecting member positioned adjacent to said slot;

a circuit card mounted to said exterior surface of said wall;

a flexible printed circuit having a first end portion and a second end portion, said first end portion being secured to said circuit card, said flexible printed circuit being laced through said slot, said flexible printed circuit including at least one hole to correspondingly receive said at least one first projecting member, said second end portion passing over a portion of said interior surface and around said distal end of said wall; and an attachment mechanism for securing said second end portion to said exterior surface of said wall.

15. The imaging device of claim 14, said at least one first projecting member including a first plurality of projecting members that extend into said slot, and said at least one hole including a corresponding first plurality of holes to receive said first plurality of projecting members.

16. The imaging device of claim 14, wherein said at least one projecting member includes at least one post that extends into said slot.

17. The imaging device of claim 14, said attachment mechanism including at least one second projecting member extending from said exterior surface of said wall of said carrier housing, and said flexible printed circuit including at least one opening located near said second end portion to correspondingly receive said at least one second projecting member, said flexible printed circuit being held in a state of tension between said at least one first projecting member and said at least one second projecting member.

18. The imaging device of claim 17, wherein said state of tension is effected by inserting a resilient member between said portion of said interior surface of said wall and said flexible printed circuit.

19. The imaging device of claim 17, wherein:

said at least one first projecting member includes a first plurality of projecting members extending into said slot and wherein said at least one hole includes a corresponding first plurality of holes to receive said first plurality of projecting members;

wherein said at least one second projecting member includes a second plurality of projecting members extending from said wall of said carrier housing and said at least one opening includes a corresponding second plurality of holes to receive said second plurality of projecting members, and wherein when said flexible printed circuit is mounted to said carrier housing, said flexible printed circuit is held in a state of tension between said first plurality of projecting members and said second plurality of projecting members.

20. The imaging device of claim 19, wherein said state of tension is effected by inserting a resilient member between said portion of said interior surface of said wall and said flexible printed circuit.

21. The imaging device of claim 19, wherein each of said first plurality of projecting members includes a first plurality of posts and wherein each of said plurality of second projecting members comprises a second plurality of posts.

22. The imaging device of claim 14, said attachment mechanism including a clamp.

23. The imaging device of claim 14, said attachment mechanism including:

a plurality of projecting members extending from said exterior surface of said wall of said carrier housing to receive a corresponding plurality of holes located near said second end portion of said flexible printed circuit; and a clamp to secure said second end portion of said flexible printed circuit to said exterior surface of said wall of said carrier housing.

24. The imaging device of claim 14, wherein said first end portion of said flexible printed circuit is secured to said circuit card by solder.

25. The imaging device of claim 14, wherein said slot extends substantially across an entire width of said wall.

26. The imaging device of claim 14, wherein said slot comprises a plurality of slots.

27. An imaging device, comprising:

a carrier housing for carrying at least one printhead, said carrier housing defined in part by a wall having an interior surface, an exterior surface and a distal end, and having a slot extending between said interior surface of said wall and said exterior surface of said wall, said slot being spaced apart from said distal end, and having a first plurality of projecting members positioned adjacent to said slot and a second plurality of projecting members extending from said exterior surface of said wall;

a circuit card mounted to said exterior surface of said wall; and a flexible printed circuit having a first end portion and a second end portion, said first end portion being secured to said circuit card, said flexible printed circuit including a first plurality of holes to correspondingly receive said first plurality of projecting members and including a second plurality of holes to correspondingly receive said second plurality of projecting members, said flexible printed circuit being laced through said slot, said second end portion passing over a portion of said interior surface and around said distal end of said wall.

28. The imaging device of claim 27, wherein when said flexible printed circuit is mounted to said housing, said flexible printed circuit is held in a state of tension between said first plurality of projecting members and said second plurality of projecting members.

29. The imaging device of claim 28, wherein said state of tension is effected by inserting a resilient member between said portion of said interior surface of said wall and said flexible printed circuit.

30. The imaging device of claim 27, wherein said first end portion of said flexible printed circuit is secured to said circuit card by solder.

31. The imaging device of claim 27, wherein said slot extends substantially across an entire width of said wall.

32. The imaging device of claim 27, wherein said slot comprises a plurality of slots.

33. The imaging device of claim 27, further comprising a clamp for securing said second end portion to said exterior surface of said wall.

34. The imaging device of claim 27, wherein said first plurality of projecting members extends into said slot.

* * * * *